US007050006B2

(12) United States Patent
Jan et al.

(10) Patent No.: US 7,050,006 B2
(45) Date of Patent: May 23, 2006

(54) SIGNAL RECEIVER

(75) Inventors: Cheng-Geng Jan, Taipei Hsien (TW); Jin-Chung Lin, Taipei Hsien (TW); Jui-Hsiang Chou, Taipei Hsien (TW); Chieh-Sheng Hsu, Taipei Hsien (TW)

(73) Assignee: Wistron Neweb Corp., Taipei Hsien (TW)

( * ) Notice: Subject to any disclaimer, the term of this patent is extended or adjusted under 35 U.S.C. 154(b) by 0 days.

(21) Appl. No.: 10/952,060

(22) Filed: Sep. 28, 2004

(65) Prior Publication Data

US 2005/0104779 A1 May 19, 2005

(30) Foreign Application Priority Data

Nov. 14, 2003 (TW) ..... 92131937 A

(51) Int. Cl.
*H01Q 1/38* (2006.01)

(52) U.S. Cl. ..... 343/700 MS; 343/906

(58) Field of Classification Search ..... 343/700 MS, 343/702, 791, 846, 906, 790
See application file for complete search history.

(56) References Cited

U.S. PATENT DOCUMENTS 6,392,601 B1 5/2002 Ku et al. ..... 343/700 MS
6,492,947 B1 * 12/2002 Anderson ..... 343/700 MS
6,812,891 B1 * 11/2004 Montgomery et al. ..... 343/700 MS
6,836,246 B1 * 12/2004 Kadambi et al. .... 343/700 MS

OTHER PUBLICATIONS

"Low-Cost Spiral Antenna with Dual-Mode Radiation Pattern for Integrated Radio Services" Gschwendtner, et al.
"A Combination Monopole/Quadrifilar Helix Antenna for S-Band Terrestrial/Satellite Applications" McCarrick; May 2001.

* cited by examiner

*Primary Examiner*—Shih-Chao Chen
(74) *Attorney, Agent, or Firm*—Thomas, Kayden, Horstemeyer & Risley

(57) ABSTRACT

A signal receiver. The signal receiver comprises a flat antenna, a partition, a board, and a plug. The antenna has a receiving element and an antenna surface. The partition has a first partition surface and a second partition surface. The first partition surface contacts the antenna surface. The board has a first board surface, a second board surface and a circuit. The first board surface contacts the second partition surface. The circuit is disposed on the second board surface. The plug has a first pin which is projected through the board and fixed on the first board surface. The first pin is connected with the circuit.

16 Claims, 6 Drawing Sheets

SIGNAL RECEIVER

BACKGROUND OF THE INVENTION

1. Field of the Invention

The present invention relates to a signal receiver, and in particular to signal receiver with low noise.

2. Description of the Related Art

FIG. 1 shows a conventional satellite signal receiver 100 which comprises a flat antenna 110, a board 120, a wire 130 and a plug 131. The flat antenna 110 and the board 120 are welded together. The wire 130 is connected with a circuit disposed on the board 120. The wire 130 is a coaxial cable. If the plug 131 is arranged near the side of the flat antenna 110, the performance of antenna is, however, affected.

To provide better performance, the plug 131 can be arranged under the board 120; thus, the wire 130 must be bended to downsize the receiver 100. However, when bended, the electric characteristics of the wire 130 can be changed, thus the performance of the satellite signal receiver 100 is affected by bending the wire 130.

A harder coaxial cable can reduce such defect caused by bending. The harder coaxial cable is more expensive and is less flexible. Moreover, the satellite signal receiver 100 utilizing the harder coaxial cable has a bigger volume.

Additionally, welding the flat antenna 110 and the board 120 together complicates manufacturing process of the receiver 100. Moreover, both the flat antenna 110 and the board 120 must be replaced simultaneously, even if only one of them is malfunctioned.

SUMMARY OF THE INVENTION

The present invention provides a signal receiving apparatus that comprises a flat antenna, a partition, a board, and a plug. The flat antenna has a receiving element and an antenna grounding surface. The partition has a first partition surface and a second partition surface, in which the first partition surface contacts the antenna grounding surface. The board has a first board surface, a second board surface and a circuit. The first board surface contacts the second partition surface and the circuit is disposed on the second board surface. The plug has a first pin piercing through the board and being fixed on the first board surface. The first pin is connected with the circuit.

The present invention provides an easily manufactured signal receiver which has a simpler structure, a smaller volume and a lower cost.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
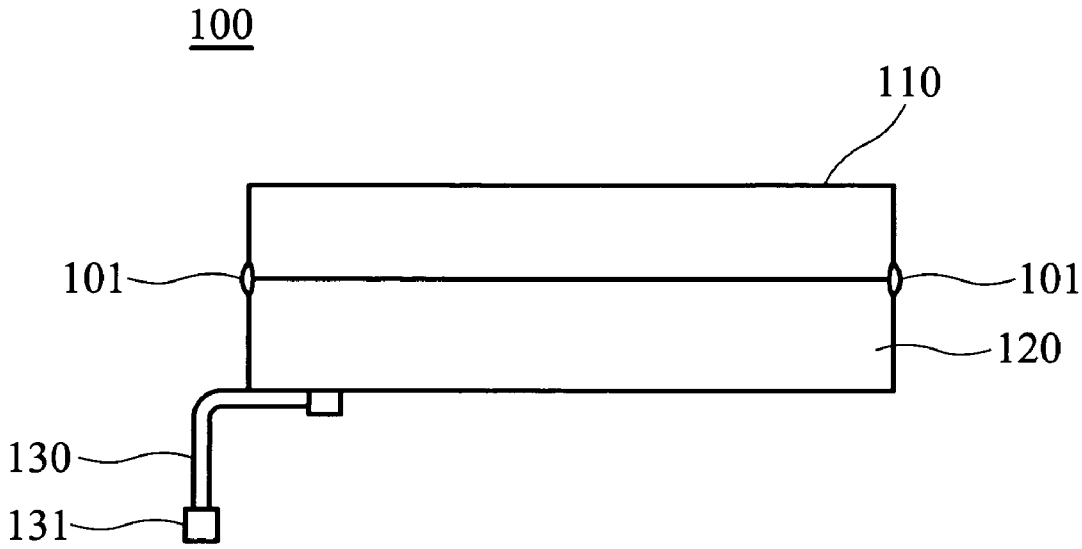
FIG. 1 (RELATED ART)
FIG. 1 shows the conventional signal receiver.
Figure 2A:
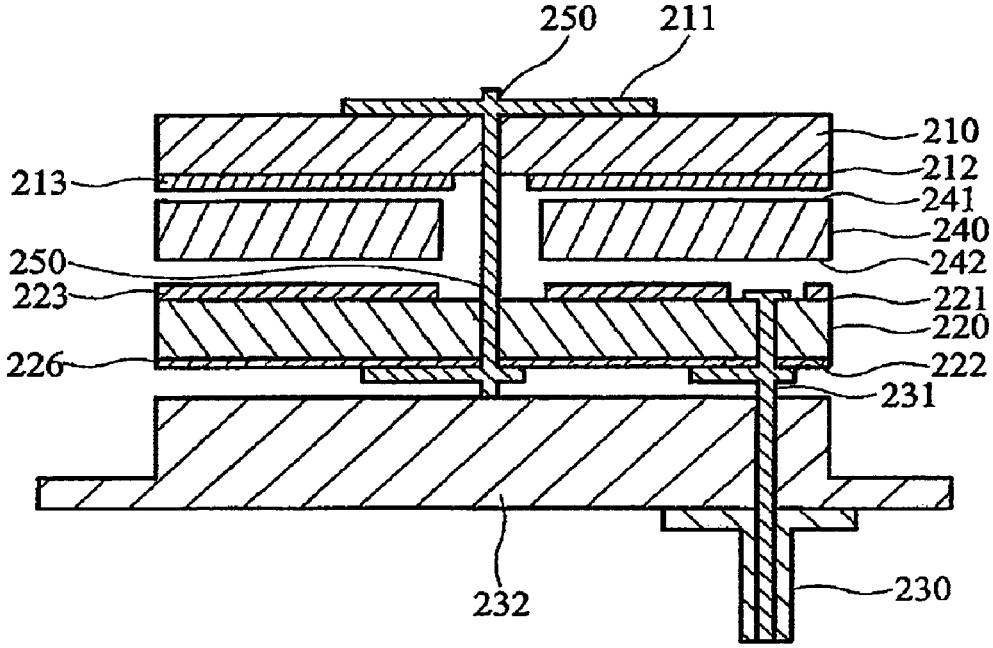
FIG. 2*a* shows the signal receiver of the present invention.

FIG. 2*a* shows a first embodiment of the present invention, which comprises a flat antenna 210, a partition 240, a circuit board 220, a second pin 250 and a plug 230. The flat antenna 210 has a receiving element 211 and an antenna grounding 212. The receiving element 211 can be a metal plate. The partition 240 has a first partition surface 241 and a second partition surface 242. The first partition surface 241 contacts the antenna grounding 212. The circuit board 220 has a first board surface 221, a second board surface 222, a circuit 226 and a board ground 223. The board ground 223 is disposed on the first board surface 221. The circuit 226 is disposed on the second board surface 222. The board ground 223 contacts the second partition surface 242. The plug 230 has a first pin 231 through the board 220 and fixed on the first board surface 221. The first pin 231 is connected with the circuit. The second pin 250 passes through the flat antenna 210, the partition 240 and the board 220, and transmits a signal from the receiving element 211 to the circuit.

The signal mentioned above can be a microwave signal, and the plug 230 is a RF (radio frequency) plug.

The flat antenna 210, the partition 240 and the board 220 are jointed by screwing. According to the present invention, the flat antenna 210, the partition 240 and the board 220 can be easily assembled and dissembled comparing to the traditional welding method. When either the flat antenna 210 or the board 220 deteriorates, the defect part can be replaced separately.

The partition 240 is a metal plate, preferably made of high-rigidity materials such as stainless steel. The partition 240 is grounded to reduce undesired oscillation or noise between the antenna 210 and the board 220.

Figure 2B:
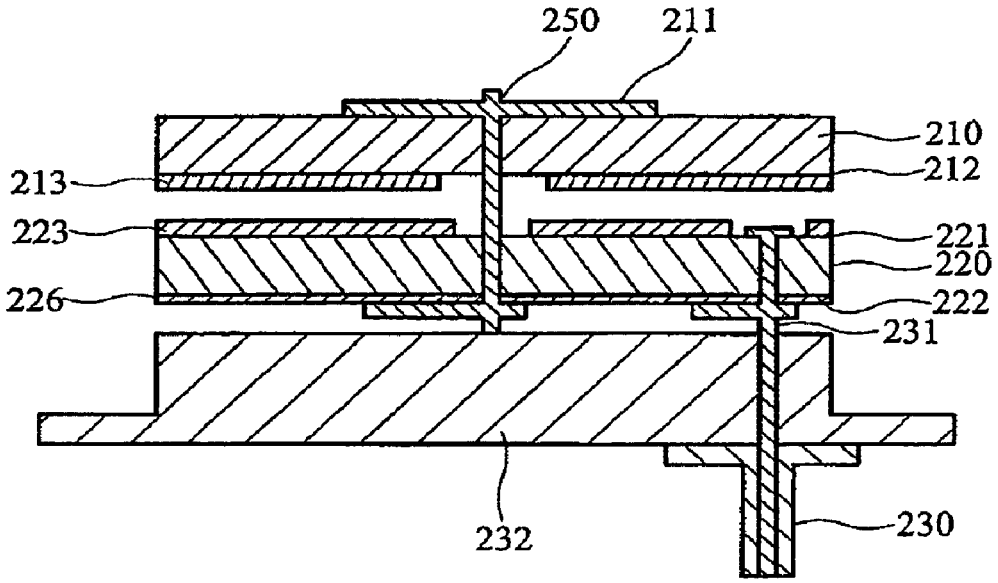
FIG. 2*b* shows the signal receiver of the present invention with no partition.

FIG. 2*b* shows the second embodiment of the present invention. The undesired oscillation or noise can also be reduced by directly contacting the antenna grounding 212 with the board ground 223 without insertion of partition 240.

Moreover, if without partition 240, the shape of antenna grounding 212 must fits the shape of the board ground 223 to provide sufficient shielding effect. Since the flat antenna 210 is relatively expensive, the cost can be increased when flat antenna 210 has the same size as the circuit board.

Figure 2C:
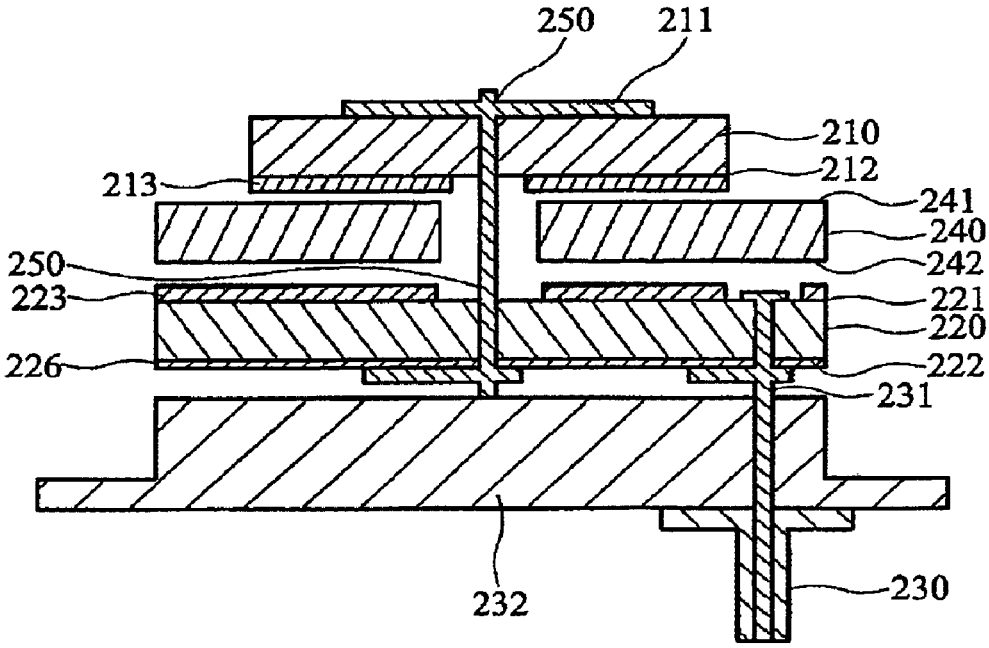
FIG. 2*c* shows the signal receiver of the present invention with a smaller flat antenna.
Figure 2D:
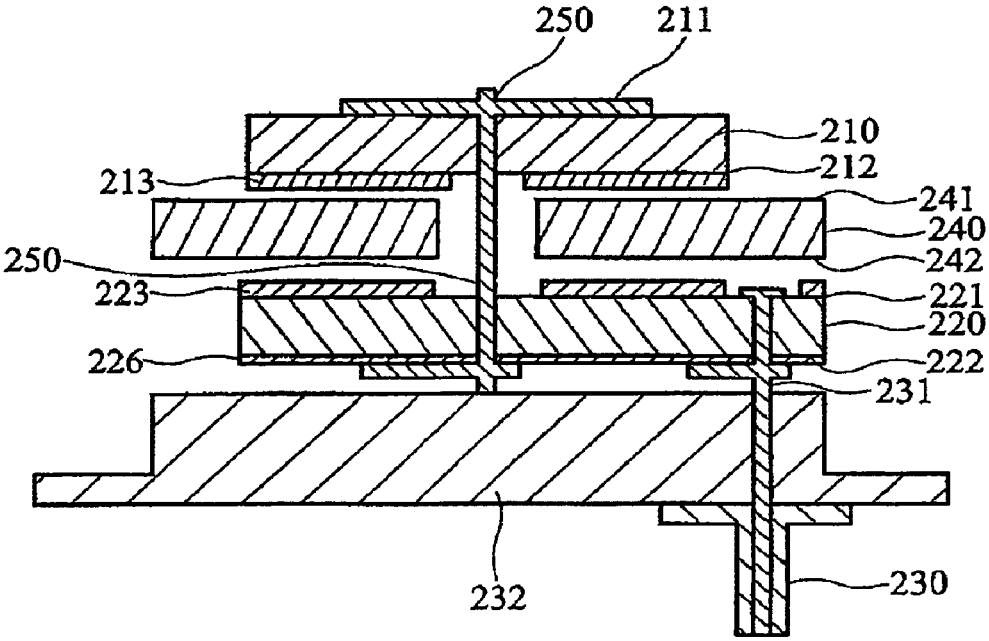
FIG. 2*d* shows the signal receiver of the present invention with a smaller board.

Referring now to FIG. 2*c*, the size of receiving element 211 is smaller than the circuit board 220. As partition 240 is introduced between the flat antenna 210 and the circuit board 220, the size of the flat antenna 210 can be further reduced to lower material cost. Further more, as shown in FIG. 2*d*, the size of the board 220 can also be reduced without considering the shape of either flat antenna 210 or circuit board 220. Thus, the partition 240 of the present invention provides better oscillation reduction effect and lowers the material cost.

Figure 3:
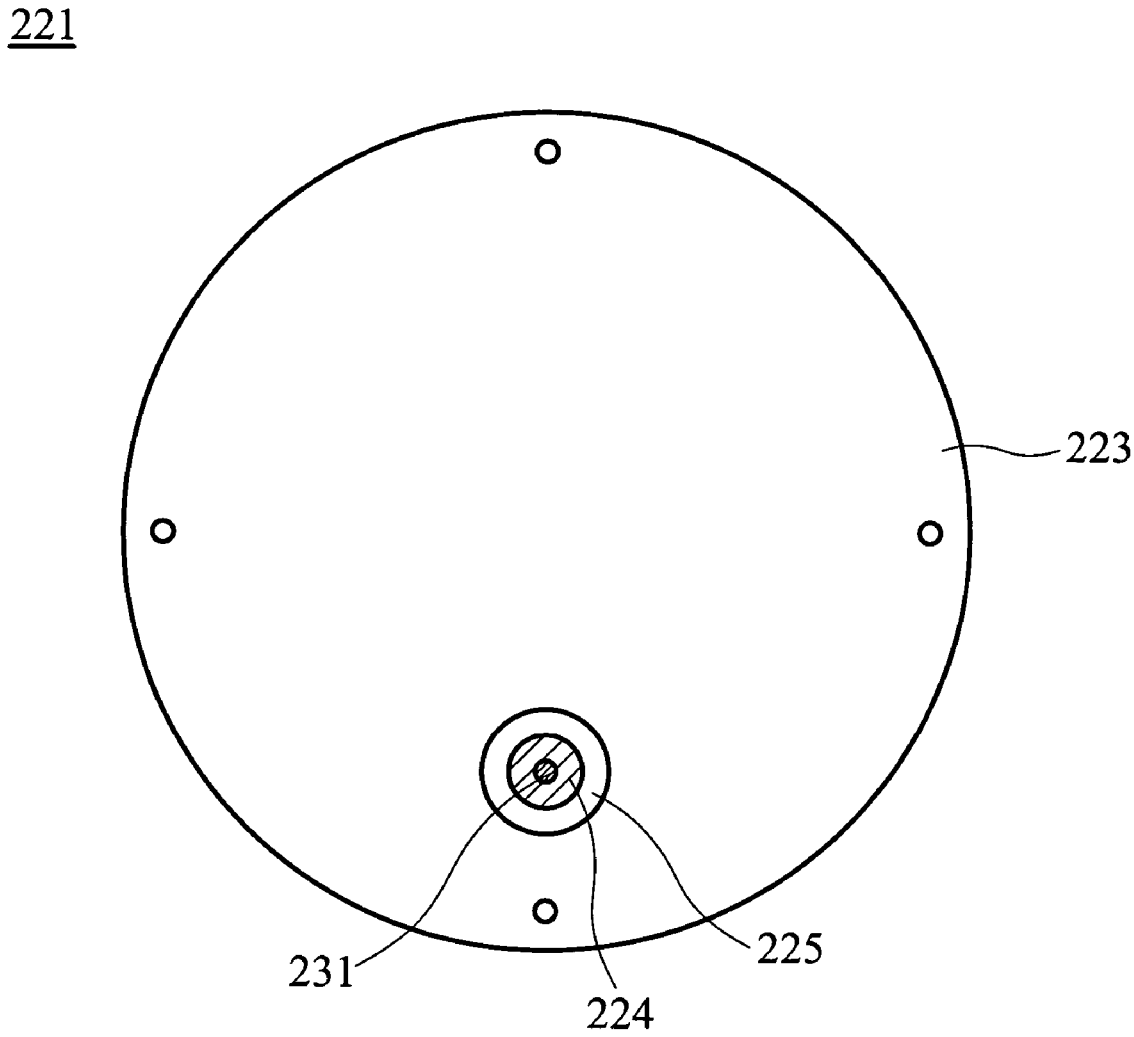
FIG. 3 shows the board ground of the present invention.

With reference to FIG. 2*a*, the present invention replaces the conventional coaxial cable with the first pin 231 to output signal from the bottom of the board 220, thus provides improved appearance and reduces noise. The cost of the first pin 231 is lower than that of the coaxial cable; thus, the cost is decreased. The first pin 231 is fixed on the first board surface 221 by welding. As shown in FIG. 3, a metal circle 224 is formed on the first board surface 221. A circular gap 225 is formed around the metal circle 224 to prevent the first pin 231 from connecting to the board ground 223. A through hole is formed in the center of the metal circle 224, which has conductive material (e.g. copper) plated on the inner wall thereof. The conductive material connects the metal circle 224 with the circuit disposed on the second board surface 222. The first pin 231 is welded on the metal circle 224; thus, the first pin 231 is connected with the circuit. The present invention provides a stable and simpler way to output the signal.

Figure 4A:
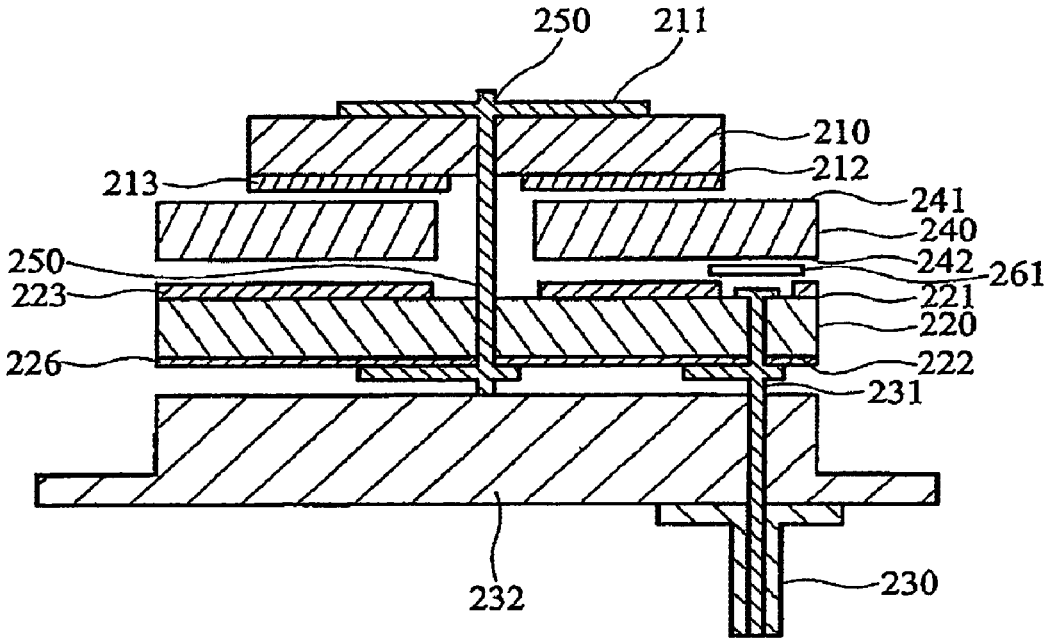
FIG. 4*a* shows the present invention with an insulating shield.
Figure 4B:
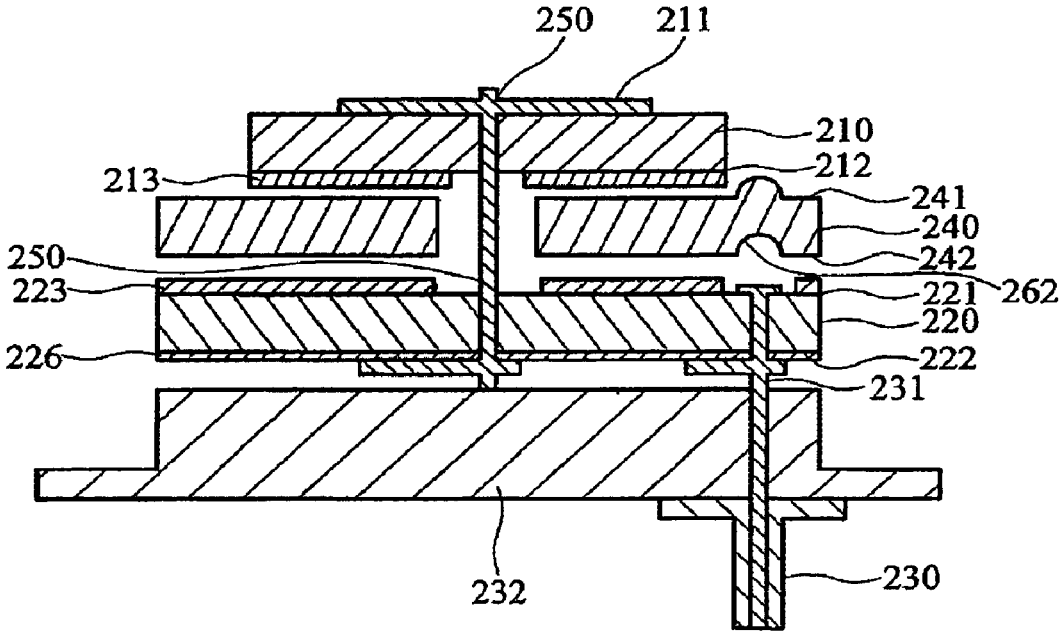
FIG. 4*b* shows the present invention with a recess formed by punching.
Figure 4C:
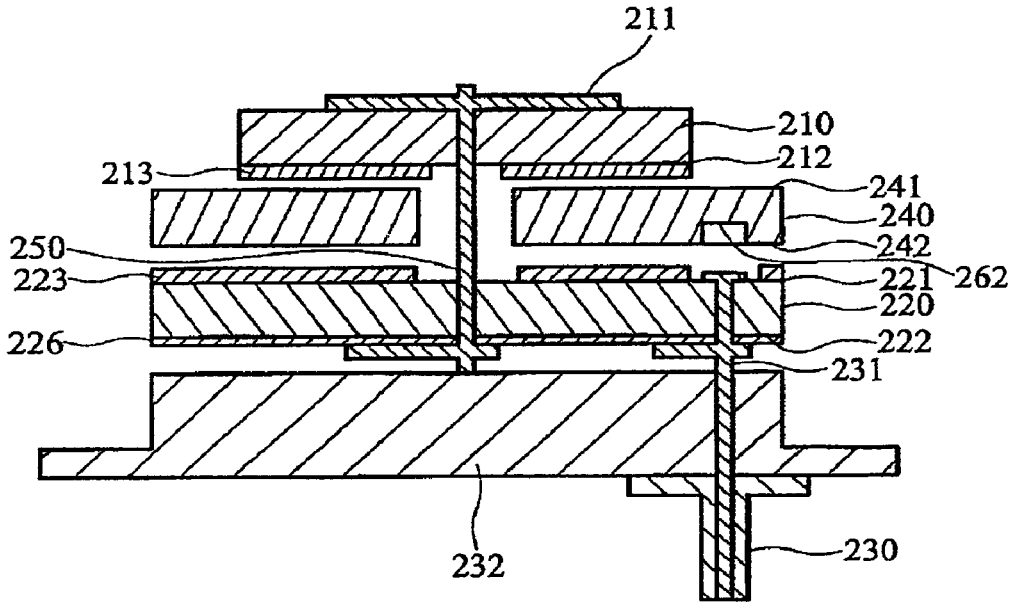
FIG. 4*c* shows the present invention with a recess.

As shown in FIG. 4*a*, an insulating shield 261 is disposed above the top the first pin 231 to prevent the first pin 231 from contacting the partition 240. As shown in FIG. 4*b*, a recess 262 is formed on the second partition surface 242 to prevent the first pin 231 from contacting the partition 240. Here the recess 262 is formed by punching. As shown in FIG. 4*c*, the recess 262 can also be formed on the second partition surface 242 by directly removing the material thereof. In addition, the top of the first pin 231 can also be designed to be lower than the board ground 223 to prevent the first pin 231 from contacting the partition 240.

The variation mentioned in FIGS. 4*a* to 4*c* (e.g. the insulating shield) can also be utilized on the second embodiment of the present invention disclosed in FIG. 2*b*. It is also possible to incorporate only the partition 240 structure without the plug 230 to simplify the structure.

The present invention provides an easily manufactured signal receiver which has a simpler structure, a smaller volume and a lower cost.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A signal receiver, comprising:

a flat antenna, having a receiving element and an antenna grounding surface;

a partition, having a first partition surface and a second partition surface, the first partition surface contacting the antenna grounding surface;

a board having a first board surface, a second board surface and a circuit, the first board surface contacting the second partition surface, the circuit being disposed on the second board surface;

a plug having a first pin electrically connected with the circuit, wherein the first pin pierces through the board and is fixed onto the first board surface; and a second pin connecting the receiving element and the circuit for transmitting signals from the receiving element to the circuit.

2. The signal receiver as claimed in claim 1, wherein the partition is a metal plate.

3. The signal receiver as claimed in claim 2, wherein the partition is made of stainless steel.

4. The signal receiver as claimed in claim 2, wherein the partition is grounded.

5. The signal receiver as claimed in claim 1, wherein the flat antenna further has an antenna ground, disposed on the antenna grounding surface.

6. The signal receiver as claimed in claim 1, wherein the board further has a board ground, disposed on the first board surface.

7. The signal receiver as claimed in claim 6, wherein the top of the first pin is lower than a thickness of the board ground.

8. The signal receiver as claimed in claim 1, further comprising an insulating shield, disposed between the first pin and the partition.

9. The signal receiver as claimed in claim 1, wherein the partition has a recess to prevent the partition from contacting the first pin.

10. A signal receiver, comprising:

a flat antenna having a receiving element and an antenna grounding;

a board having a first board surface, a second board surface, and a circuit, wherein the first board surface contacting the antenna grounding and the circuit is disposed on the second board surface; and a plug having a first pin, wherein the first pin is fixed onto the board and is electrically connected with the circuit.

11. The signal receiver as claimed in claim 10, wherein the first pin pierces through the board.

12. The signal receiver as claimed in claim 10, wherein the first board surface further has a board grounding and the antenna grounding contacts the first board surface through the board grounding.

13. The signal receiver as claimed in claim 12, wherein a top of the first pin is lower than a thickness of the board grounding.

14. The signal receiver as claimed in claim 10, further comprising a second pin piercing through the flat antenna and the board for transmitting signals from the receiving element to the circuit.

15. The signal receiver as claimed in claim 10, further comprising an insulating shield disposed between the first pin and the flat antenna.

16. The signal receiver as claimed in claim 10, wherein the flat antenna has a recess to prevent the first pin from contacting the antenna grounding.

* * * * *